US007810680B2

(12) United States Patent
Stull et al.

(10) Patent No.: US 7,810,680 B2
(45) Date of Patent: Oct. 12, 2010

(54) SHOCK RESISTANT BREAK-OFF TOP

(75) Inventors: Jameson P. Stull, Far Hills, NJ (US); Joseph Valley, Oxford, NJ (US); Robert T. Auer, East Stroudsburg, PA (US)

(73) Assignee: Stull Technologies, Inc., Somerset, NY (US)

( * ) Notice: Subject to any disclaimer, the term of this patent is extended or adjusted under 35 U.S.C. 154(b) by 858 days.

(21) Appl. No.: 11/236,950

(22) Filed: Sep. 28, 2005

(65) Prior Publication Data

US 2006/0070999 A1 Apr. 6, 2006

Related U.S. Application Data

(60) Provisional application No. 60/613,896, filed on Sep. 28, 2004.

(51) Int. Cl.
*B65D 39/00* (2006.01)

(52) U.S. Cl. ..... 222/541.9; 222/541.1; 220/257.2; 220/254.1; 220/266; 215/253; 215/48

(58) Field of Classification Search ..... 222/541.1, 222/541.5, 541.6, 541.9; 215/46–50, 250–253; 220/254.1, 256.1, 257.1, 257.2, 266, 270, 220/276

See application file for complete search history.

(56) References Cited

U.S. PATENT DOCUMENTS 3,460,724 A * 8/1969 Chmela ..... 222/541.5
4,248,227 A 2/1981 Thomas
4,566,613 A * 1/1986 Anscomb ..... 222/541.9
5,221,029 A 6/1993 Stull
D350,694 S 9/1994 Kovacic et al.
5,361,947 A 11/1994 Lifshey
5,788,100 A * 8/1998 Sturk ..... 215/258
D401,508 S 11/1998 Brown, III
5,908,124 A 6/1999 Klauke et al.
D413,117 S 8/1999 Chintala et al.
5,944,206 A 8/1999 Culter et al.
6,068,148 A 5/2000 Weiler
6,543,655 B1 4/2003 de Laforcade
2002/0170926 A1* 11/2002 Horner et al. ..... 222/137
2003/0127472 A1* 7/2003 Doherty et al. ..... 222/541.5

* cited by examiner

*Primary Examiner*—J. Casimer Jacyna
(74) *Attorney, Agent, or Firm*—Drinker Biddle & Reath LLP

(57) ABSTRACT

The present invention is a top for a dispensing container. The top includes a base, a nozzle portion extending from a first end of the base, and a tab integrally formed with the nozzle portion at a neck down portion. The nozzle portion has an outer wall defining an internal conduit for passage of a liquid, powder and/or gel. The tab includes a tip end sealing the internal conduit and at least one shock absorbing portion. When the tab is twisted, the tip end is removed from the nozzle portion at the neck down portion, thereby opening the internal conduit. The shock absorbing portion can include a slot, an area with reduced thickness, a flex area, or a combination thereof. The top can be included on a container for storing liquids, powders and/or gels.

18 Claims, 16 Drawing Sheets

SHOCK RESISTANT BREAK-OFF TOP

RELATED APPLICATION

This application is related to and claims priority from U.S. Provisional Patent Application No. 60/613,896, filed Sep. 28, 2005, which is incorporated herein by reference in its entirety.

FIELD OF THE INVENTION

The present invention relates to the field of liquid, powder and/or gel dispensers. Particularly, the invention relates to break-off tops for liquid, powder and/or gel dispensers.

BACKGROUND OF THE INVENTION

The present invention relates to a shock-resistant break-off top for use in dispensing products from a container, such as hair-care products. Conventional containers include a top with a dispensing nozzle tip. To prevent accidental discharge during shipment, the top includes a break-off tab which is molded as part of the top and covers the nozzle at the tip. Twisting of the tab fractures the plastic material at the location of the nozzle tip, thus opening the nozzle and permitting dispensing the product to be dispensed.

The primary problem with conventional tops is that they are subject to breakage in the event they are accidentally dropped. The force of impact on conventional tabs results in the tabs fracturing at the nozzle tip location (which is the weakest point on the tab), causing the top to open.

SUMMARY OF THE INVENTION

In one embodiment of the present invention, a top for a dispensing container includes a base, a nozzle portion extending from a first end of the base, and a tab integrally formed with the nozzle portion at a neck down portion. The nozzle portion has an outer wall defining an internal conduit for passage of a liquid, powder and/or gel. The tab includes a tip end sealing the internal conduit and at least one shock absorbing portion. When the tab is twisted, the tip end is removed from the nozzle portion at the neck down portion, thereby opening the internal conduit. The at least one shock absorbing portion can include a slot, an area with reduced thickness, a flex area, or a combination thereof.

Another embodiment of the present invention is a container for a dispenser having a break-off top with a shock absorbing portion. The container can include a hinged bottom.

BRIEF DESCRIPTION OF THE DRAWINGS

For the purpose of illustrating the invention, there is shown in the drawings various forms which are presently disclosed; it being understood, however, that this invention is not limited to the precise arrangements and instrumentalities particularly shown.

DESCRIPTION OF THE INVENTION

The present invention addresses problems of the prior art by incorporating a fracture or absorption point in the tab at a location spaced apart from the nozzle tip location.

As used herein, the articles "a" and "an" refer to one or to more than one (i.e., to at least one) of the grammatical object of the article. By way of example, "an element" means one element or more than one element.

Figure 1:
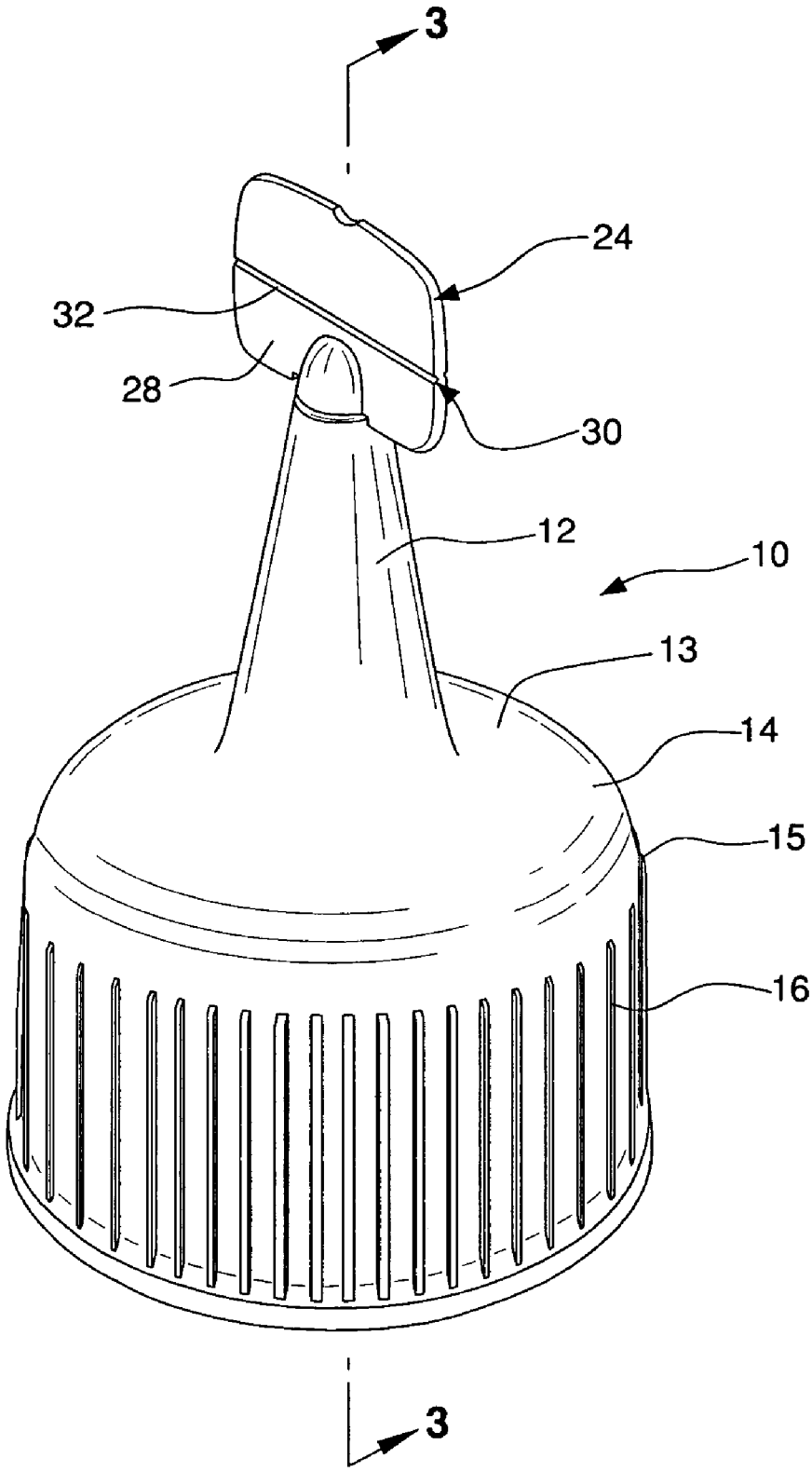
FIG. 1 is a perspective view of a dispensing nozzle according to the present invention.
Figure 2:
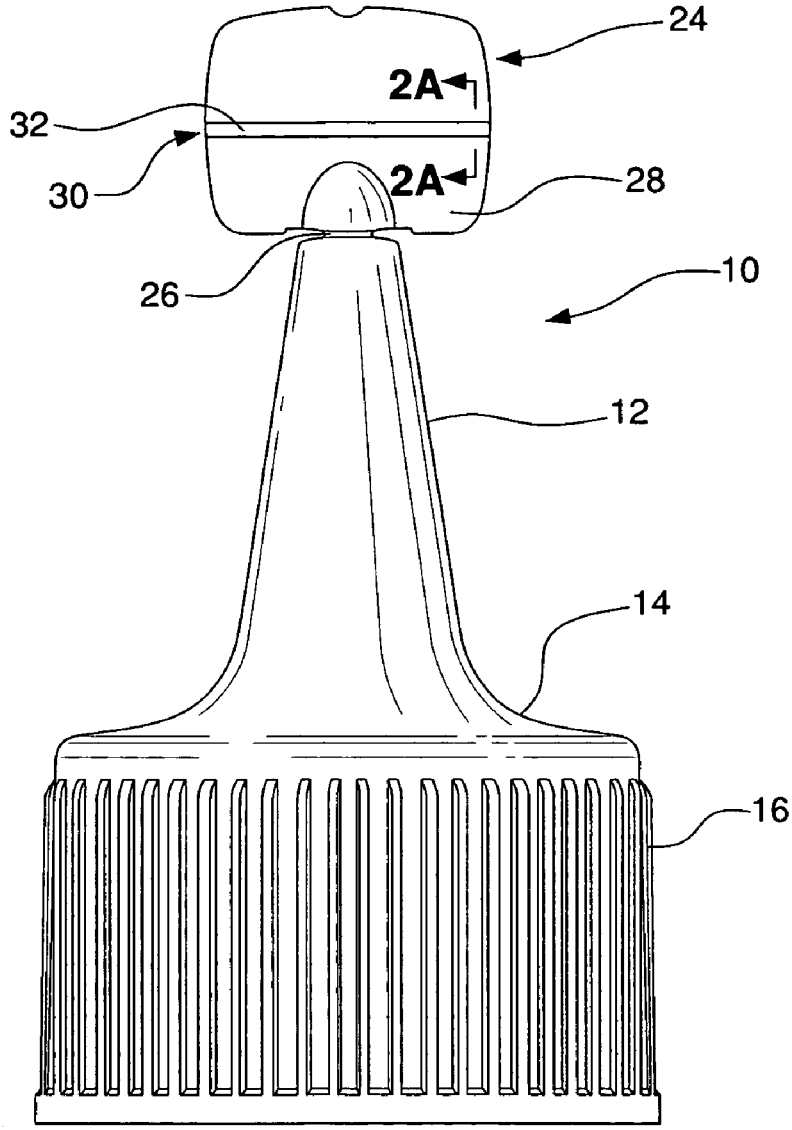
FIG. 2 is a front view of a dispensing nozzle according to the present invention.
Figure 3:
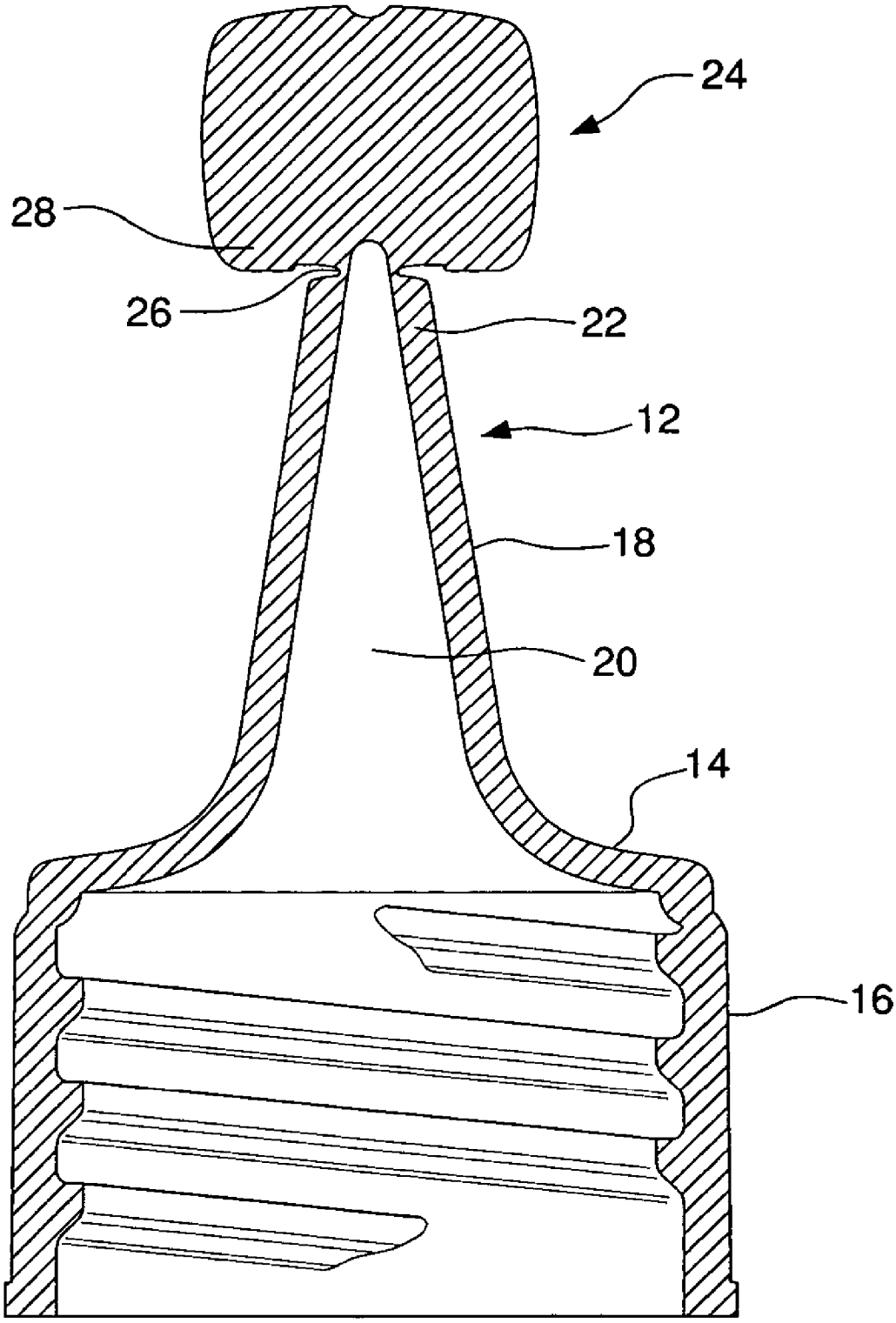
FIG. 3 is a cross-sectional view of the dispensing nozzle taken along lines 3-3 in FIG. 1.

Referring to FIGS. 1-3, a first embodiment of the invention is shown. A top 10 includes a nozzle portion 12 that is formed integral with a base 14. The base 14 includes a depending skirt 16 that is designed to engage with the top of a container through any conventional attachment mechanism, such as threads, snap-on engagement, or hinged attachment. To ensure an adequate seal at the engagement of the depending skirt and the top of the container, a seal, such as a plug seal can be included at the engagement area.

The nozzle portion 12 includes an outer wall 18 (FIG. 3) defining an internal conduit 20 for passage of a liquid, powder and/or gel. The conduit 20 extends to a tip end 22 of the nozzle portion. The tip end 22 of the conduit 20 is sealed by an integrally formed plastic tab 24. The tab 24 includes a neck-down portion 26 and a finger flange 28. The finger flange 28 is preferably wide enough to accommodate the thumb and forefinger of a user, and permit the user to twist the tab 24. Twisting of the tab 24 causes the thin wall material in the neck-down portion 26 to shear or fracture, thus breaking off the tab 24 from the nozzle portion 12.

The tab 24 also includes a shock absorbing portion 30. As used herein, the shock absorbing portion can include a thinned portion of the tab, a flex area in the tab, a slot in the tab, and combinations thereof. Also as used herein, the shock absorbing portion is designed to absorb and/or dampen loads applied to the tab 24 in the event that the container is dropped and the tab 24 contacts a hard surface. In such cases, a side (lateral) load would be applied to the tab 24. Conventional break-off tops would simple transfer the load directly to the neck-down portion 26, resulting in shearing off of the top. The present invention includes the shock absorbing portion 30 to absorb some of the side impact loads and/or redirect the loads away from the neck-down portion.

As shown in FIGS. 1 and 2, in one embodiment, the tab 24 includes a thinned (reduced thickness) portion 32 and a finger flange 28. The thinned portion 32 extends at least partially across the tab 24. The thinned portion 32 is spaced apart from the neck-down portion 26. In the illustrated embodiment, the thinned portion 32 extends completely across the tab and is formed as a molded indentation of reduced thickness on both sides of the tab 24. The thinned portion is also shown as a substantially straight line. However, it is contemplated that the thinned portion could be formed as an indentation in the tab in any desired shape, such as a curved indentation, or an inverted V-shaped indentation.

Figure 2A:
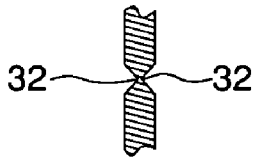
FIG. 2A is a cross-sectional view of a shock absorbing portion of the dispensing nozzle taken along lines 2A-2A in FIG. 2.

In one preferred embodiment, the thinned portion 32 is formed by a V-shaped notch on both sides of the tab 24 (see FIG. 2A). The V-shaped notch preferably has an angle of approximately 90 degrees. In one embodiment, the tab has a thickness of about 0.045 inches and the thinned portion results in a thickness that is preferably less than 50% of the tab thickness, and more preferably is about 0.010 inches thick.

In the event that a container with the top shown in these figures is dropped, the side impact loads will be absorbed by the tab as it bends and/or breaks along the thinned portion. The applied loads will naturally concentrate on the weakest point. Since the thinned portion 32 is spaced apart from the neck-down portion 26, the loads are reduced to a degree as the impact energy is dissipated through the breaking of the thinned portion. As such, the container top will remain sealed and still usable since the remaining portion of the finger flange 28 is wide enough to permit the user to break off the tab. In essence, the thinned portion 32 acts as a first line of weakness, absorbing the impact loads before the loads are able to be transferred to the neck-down portion 26 (i.e., a second line of weakness), thereby preventing unintentional breaking of the seal.

Figure 4:
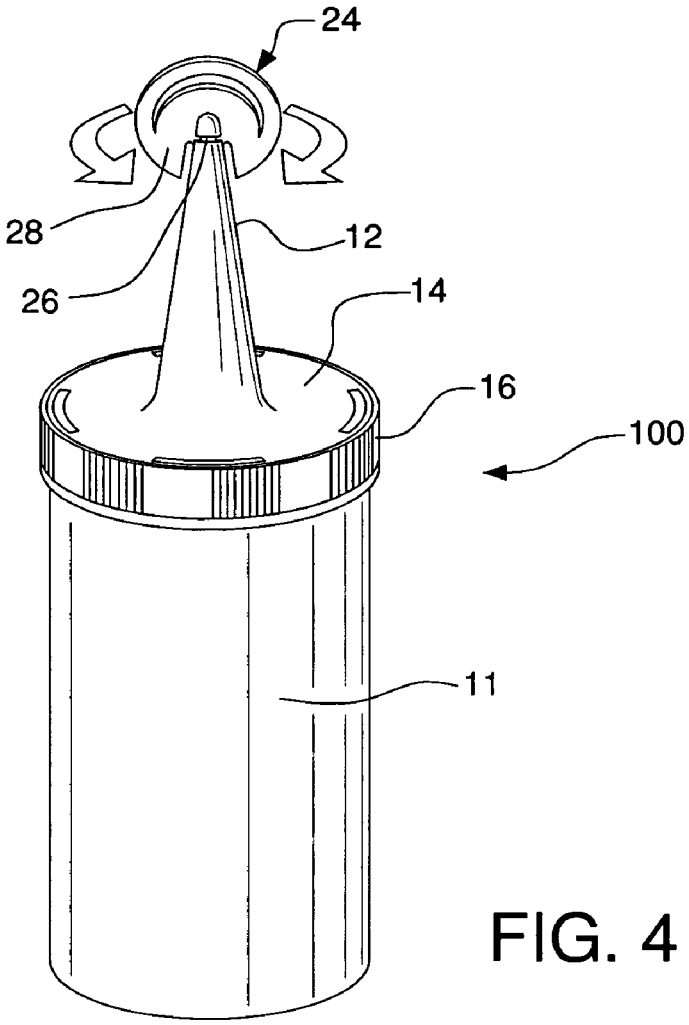
FIG. 4 is a perspective view of a container having a dispensing nozzle according to the present invention.
Figure 5:
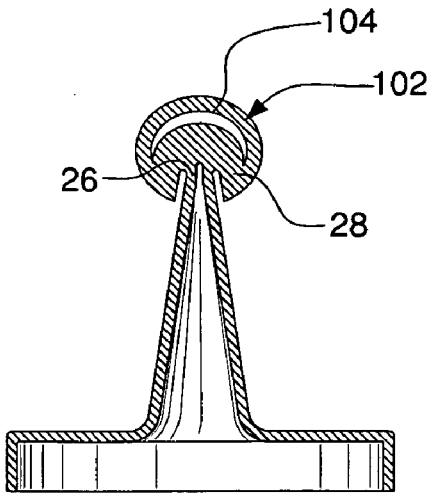
FIG. 5 is a cross-sectional view of the dispensing nozzle shown in FIG. 4.

Referring to FIGS. 4 and 5, a second embodiment of the invention is shown. In this embodiment, many of the basic components of the top 100 are the same as the prior embodiment and, thus, are identified with similar reference numerals. In addition, FIG. 4 shows the top 100 engaged with a container 11.

In this embodiment, the shock-absorbing portion 102 includes a through slot 104 formed in the tab 24. The slot 104 is spaced apart from the neck-down portion 26, as well as from the upper edge of the tab. The result is a portion of the tab being separated from the remainder of the finger flange 28. The slot 104 extends completely through the thickness of the tab 24 (forming an opening), but does not extend to the lateral edges of the tab 24. Accordingly, the portion of the tab that is separated by the slot becomes a resilient section.

The slot 104 is shown as semi-circular or crescent in shape. However, it is contemplated that the slot 104 could be formed in the tab in any desired shape such as a straight line, or an inverted V-shaped slot.

In the event that a container with the top shown in these figures is dropped, the side impact loads will be absorbed by the section of the tab located above the slot as it bends about the slot. As with the prior embodiment, this embodiment will help prevent the container top from prematurely opening when dropped.

Figure 6:
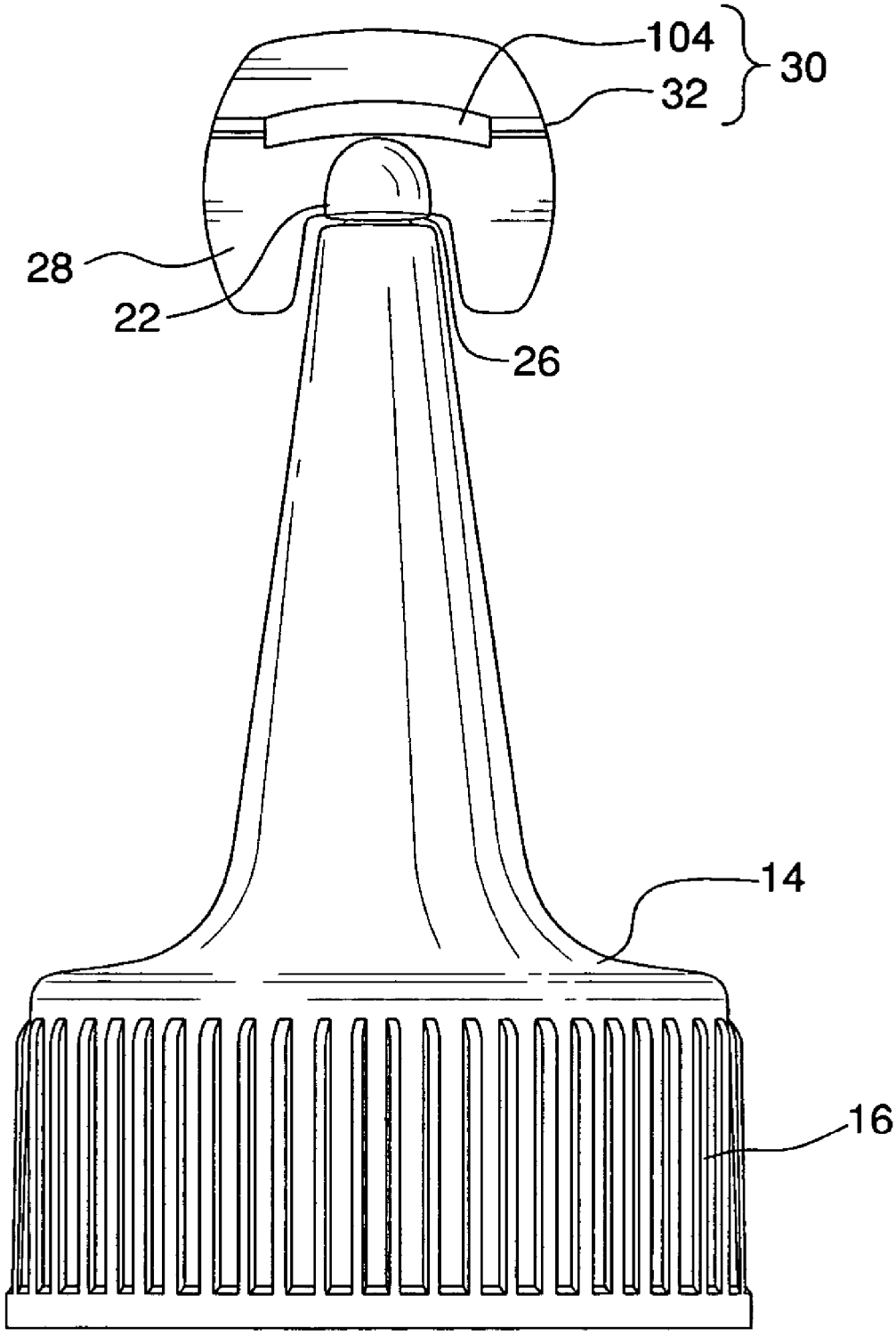
FIG. 6 is a front view of a dispensing nozzle according to the present invention.
Figure 7:
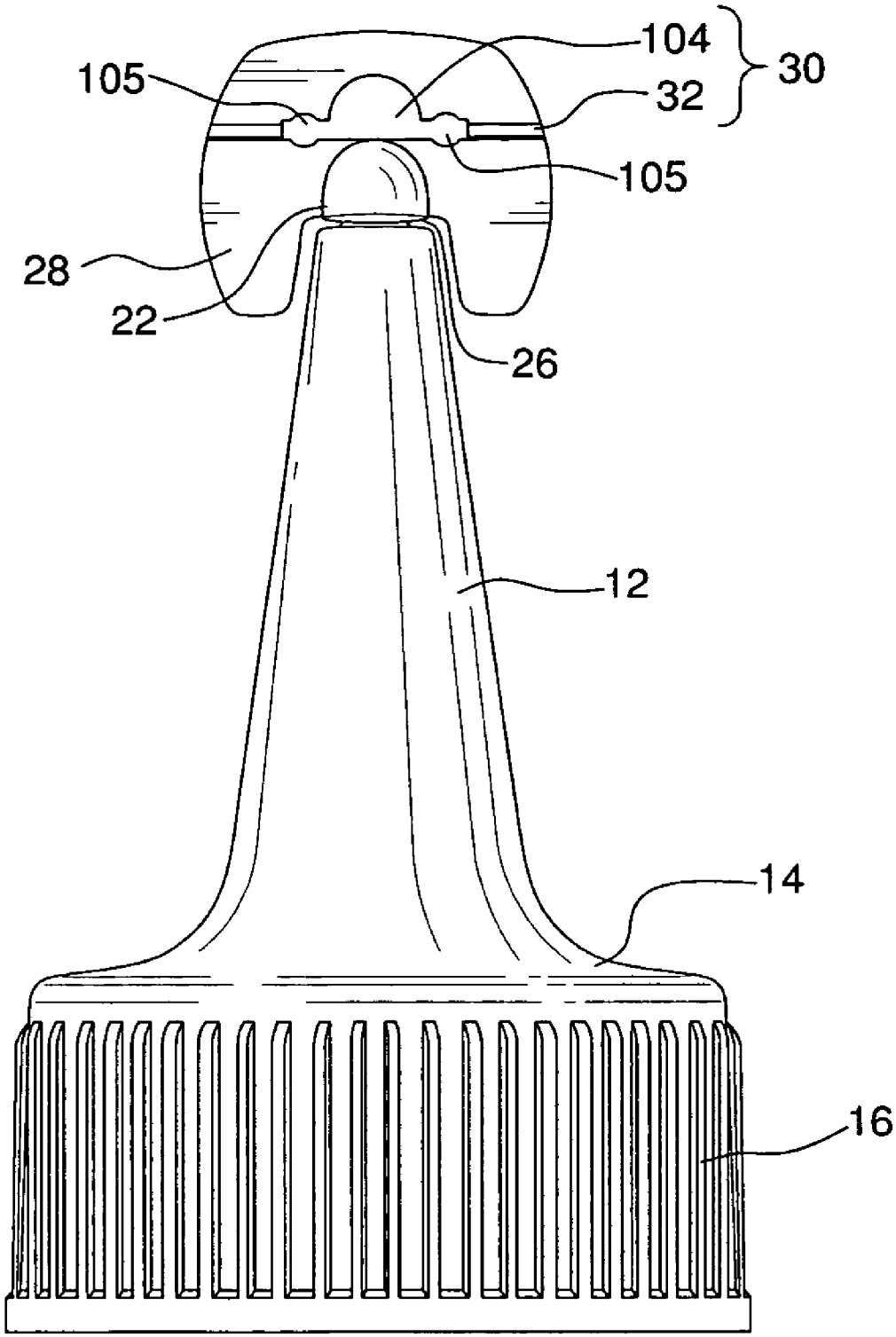
FIG. 7 is a front view of a dispensing nozzle according to the present invention.

Referring to FIGS. 6 and 7, a third embodiment of the invention is shown. In this embodiment, the slot 104 is coupled with a thinned portion 32 to form the shock absorbing portion 30 of the tab 24. In FIG. 6, the thinned portion 32 extends from the sides of the tab 24. The thinned portions 32 from either side of the tab 24 are in communication via the slot 104 that is present in the center of the tab 24. As shown, the slot 104 has a radius that mirrors the radius of the top of the tab 24. A similar orientation of the absorbing portion 30 is shown in FIG. 7, except that the slot 104 is configured to accept wire bars of standard hanging displays. As shown, the slot 104 can accept a display having two supports (not shown) through circular protuberances 105. Alternatively, the slot 104 can accept a display having just a single support (not shown) along the centerline of the slot 104.

As with the tops shown in FIGS. 4 and 5, in the event that a container with the top shown in either FIGS. 6 and 7 is dropped, the side impact loads will be absorbed by the section of the tab located above the slot as it bends about the slot. The addition of the thinned portion adjacent the slot provides for greater bending of the tab about the slot as it provides a path of lesser resistance. Consequently, there is a greater transfer of energy away from the neck-down portion, which helps to prevent the container top from prematurely opening when dropped.

Referring to FIGS. 9 through 14, various embodiments of the invention are shown. In these embodiments, many of the basic components of the top 10 are the same as the prior embodiments and, thus, are identified with similar reference numerals. In these embodiments, the shock-absorbing portion 202 is a flex area 204 formed from the configuration of the tab 24.

Each of the tops shown in FIGS. 9 through 14 can be injection molded as a one piece construction. When the tops are dropped, a flex area 204 on each of the tops bends, thereby absorbing at least a portion of the impact load. As used herein, a flex area is an area of the tab that flexes or bends, but does not break when subjected to a moderate impact load from, for example, being dropped onto an uncarpeted floor from a table top about 3 to 5 feet above the floor.

Figure 9B:
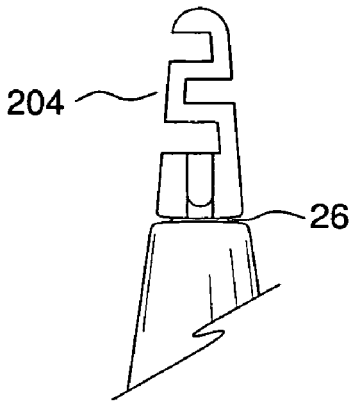
FIG. 9B is a partial side view of the dispensing nozzle shown in FIG. 9A illustrating the tab.
Figure 9A:
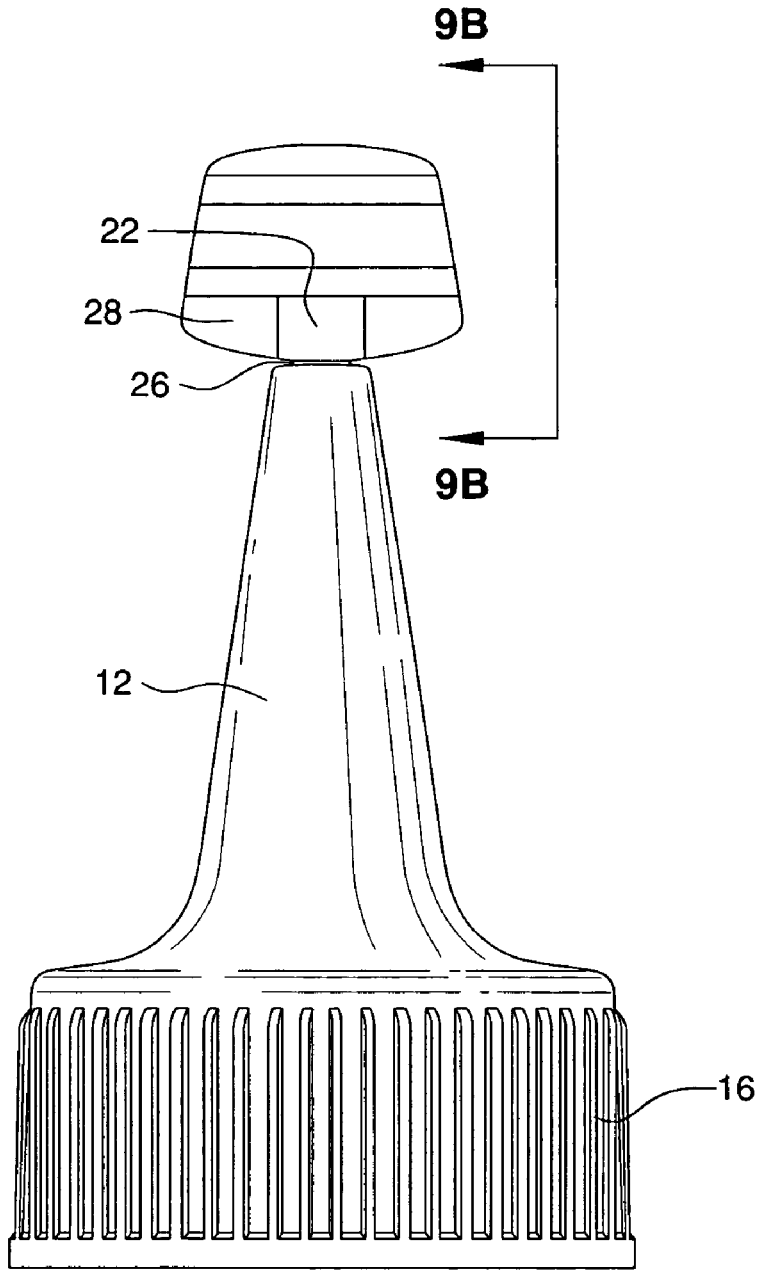
FIG. 9A is a front view of a dispensing nozzle according to the present invention.

As shown in FIGS. 9A and 9B, the flex area may be created by an arrangement of the tab 24 that in profile includes a series of alternating projections and recesses. The arrangement allows the tab 24 to act as a spring that absorbs impact loads prior to the load reaching the tip end 22. Upon impact, preferably most or all of the loads are transferred from the top of the tab to the flex area 204 that is spaced apart from the tip end 22. The flex area 204 absorbs at least a portion of the load by flexing or bending, thereby limiting the impact load on the tip end 22.

Figure 10B:
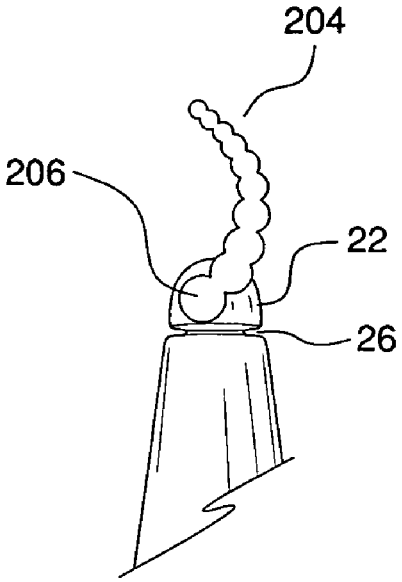
FIG. 10B is a partial side view of the dispensing nozzle shown in FIG. 10A.
Figure 10A:
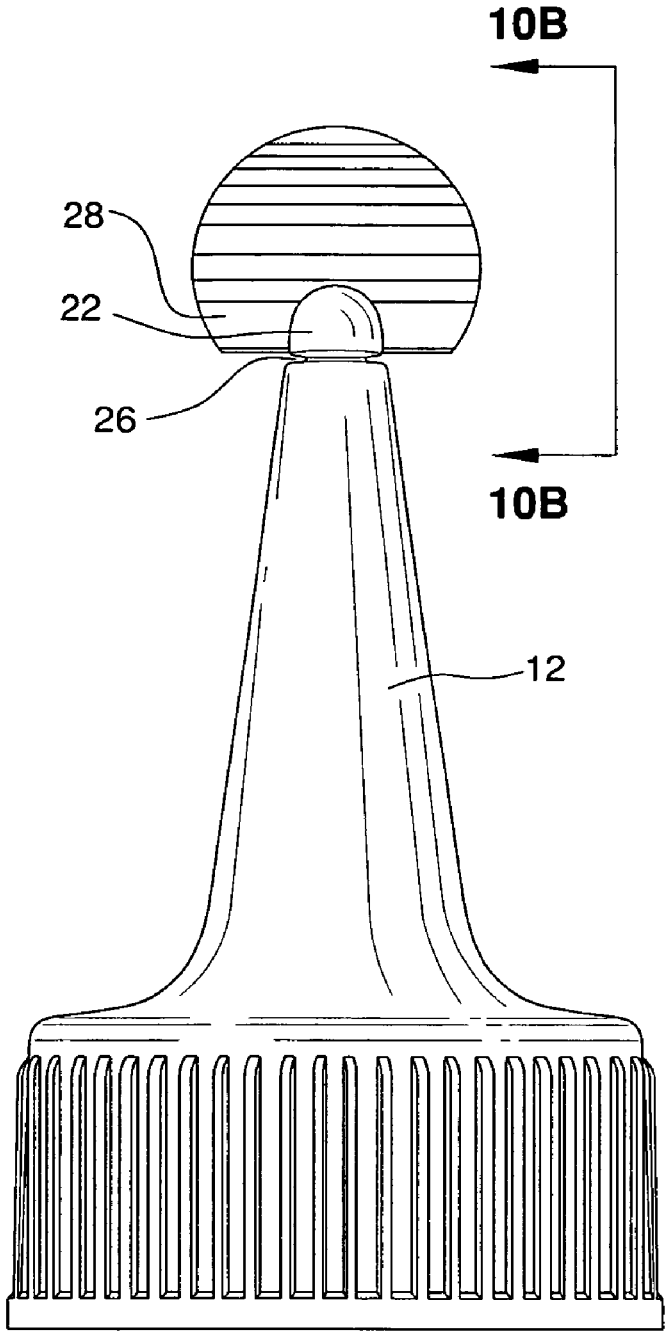
FIG. 10A is a front view of a dispensing nozzle according to the present invention.

As shown in FIGS. 10A and 10B, in one embodiment, the tab includes a series of elongated rods 206. The rods are molded together in curved orientation in order of decreasing diameter, with the largest diameter rod attached to the tip end 22 and the smallest diameter rod farthest from the tip end 22. Because of the curved orientation and because of the decreasing diameter of the rods, the tab will bend or flex at a flex area 204 under impact loads. As a result, transfer of impact loads to the tip end 22 is limited.

Figure 11B:
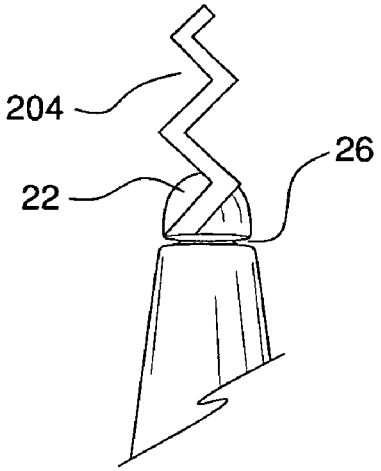
FIG. 11B is a partial side view of the dispensing nozzle shown in FIG. 11A.
Figure 11A:
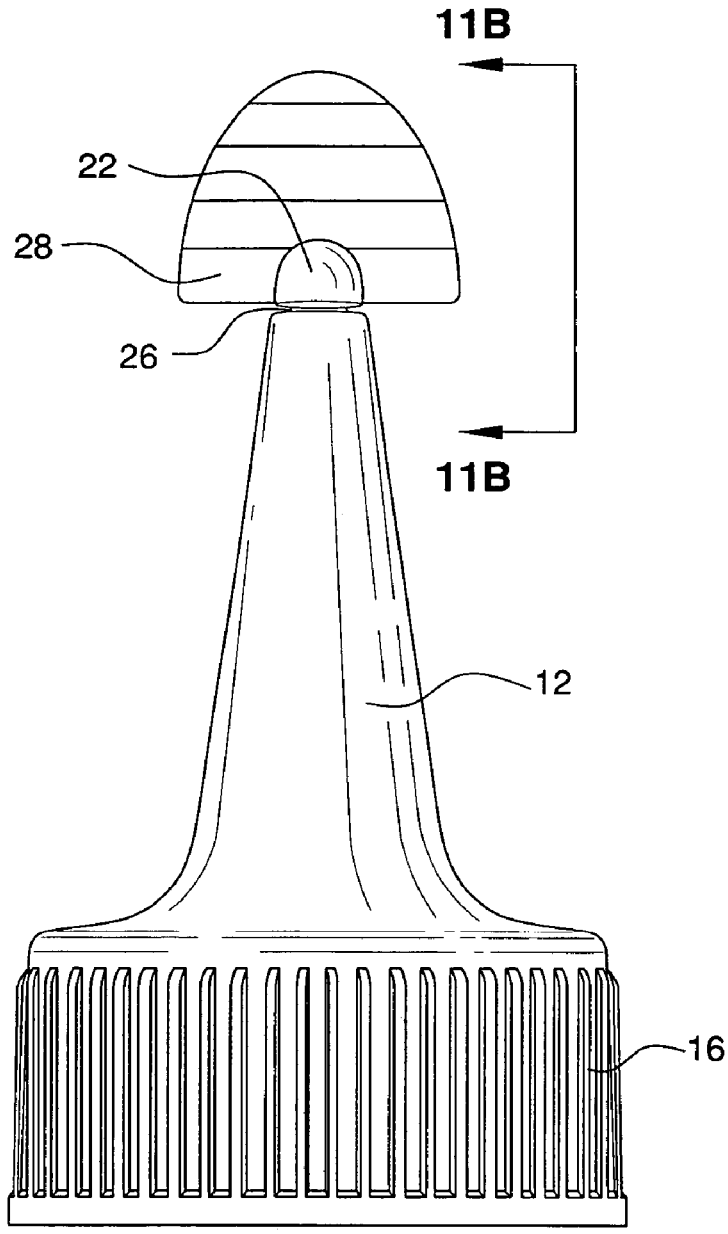
FIG. 11A is a front view of a dispensing nozzle according to the present invention.

As shown in FIGS. 11A and 11B, the flex area is created by a profile arrangement of the tab that begins with the tab being at about a 45 degree angle from the neck-down portion 26. From the neck-down portion, the tab extends at 90-degree angles at alternating directions. The arrangement allows the tab 24 to act as a spring that absorbs impact loads prior to the load reaching the tip end 22. Upon impact, the loads are transferred from the top of the tab to a flex area 204 that is apart from the tip end 22. The flex area 204 absorbs the load by flexing or bending, thereby limiting the impact load on the tip end 22.

Figure 12B:
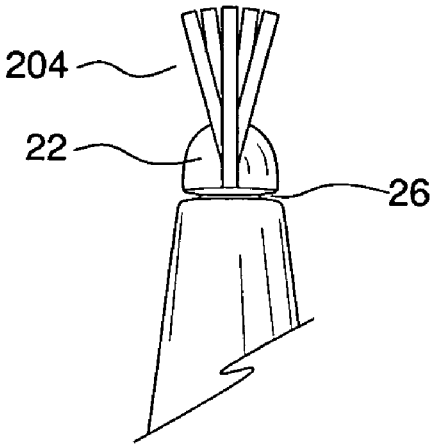
FIG. 12B is a partial side view of the dispensing nozzle shown in FIG. 12A.
Figure 12A:
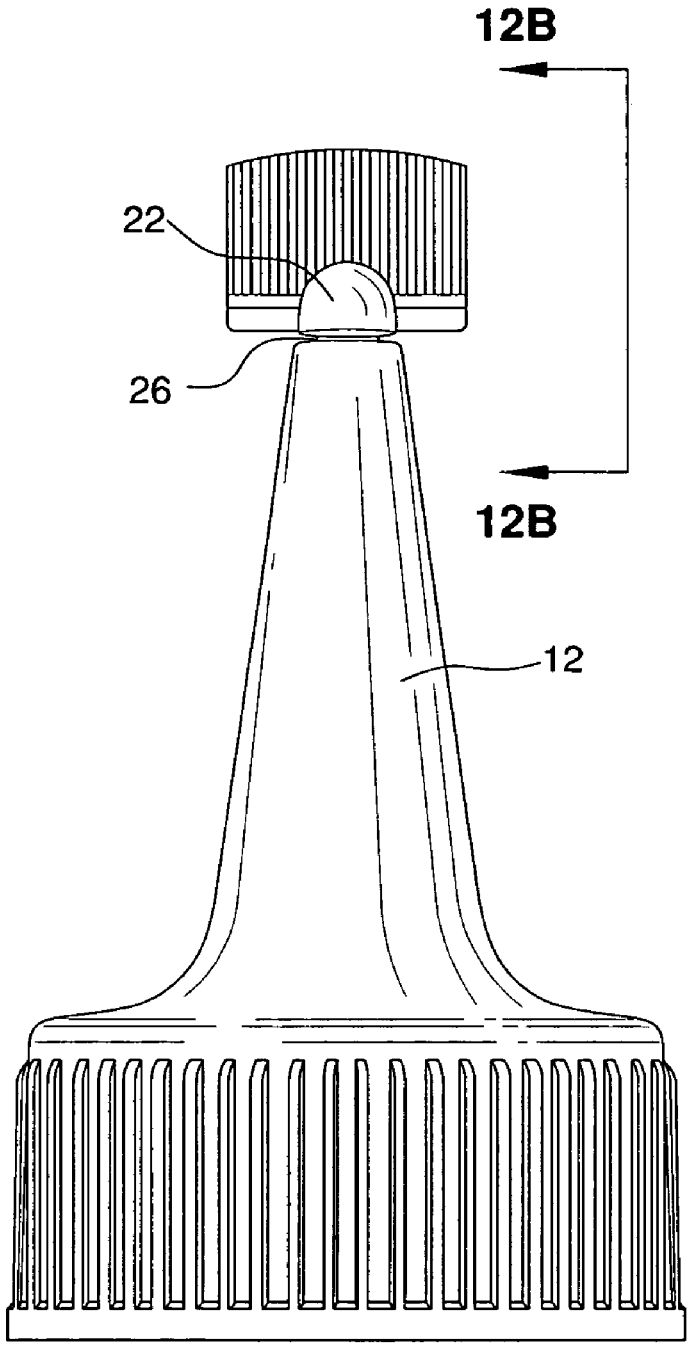
FIG. 12A is a front view of a dispensing nozzle according to the present invention.

As shown in FIGS. 12A and 12B, the flex area is created by a series of projections extending from the tip end 22. Each of the projections includes a flex area 204 apart from the tip end 22 that flexes or bend when the projections are subject to an impact load. The flexing or bending of the projections at the flex area 204 absorbs the load, thereby limiting the load on the tip end. The projections also serve to distribute the impact load over a greater area, thereby limiting the amount of load on any particular point (e.g., the tip end).

Figure 13B:
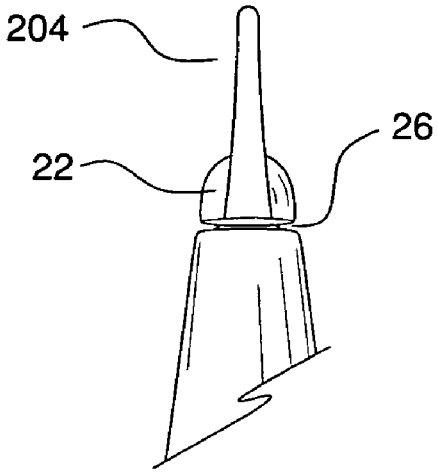
FIG. 13B is a partial side view of the dispensing nozzle shown in FIG. 13A.
Figure 13A:
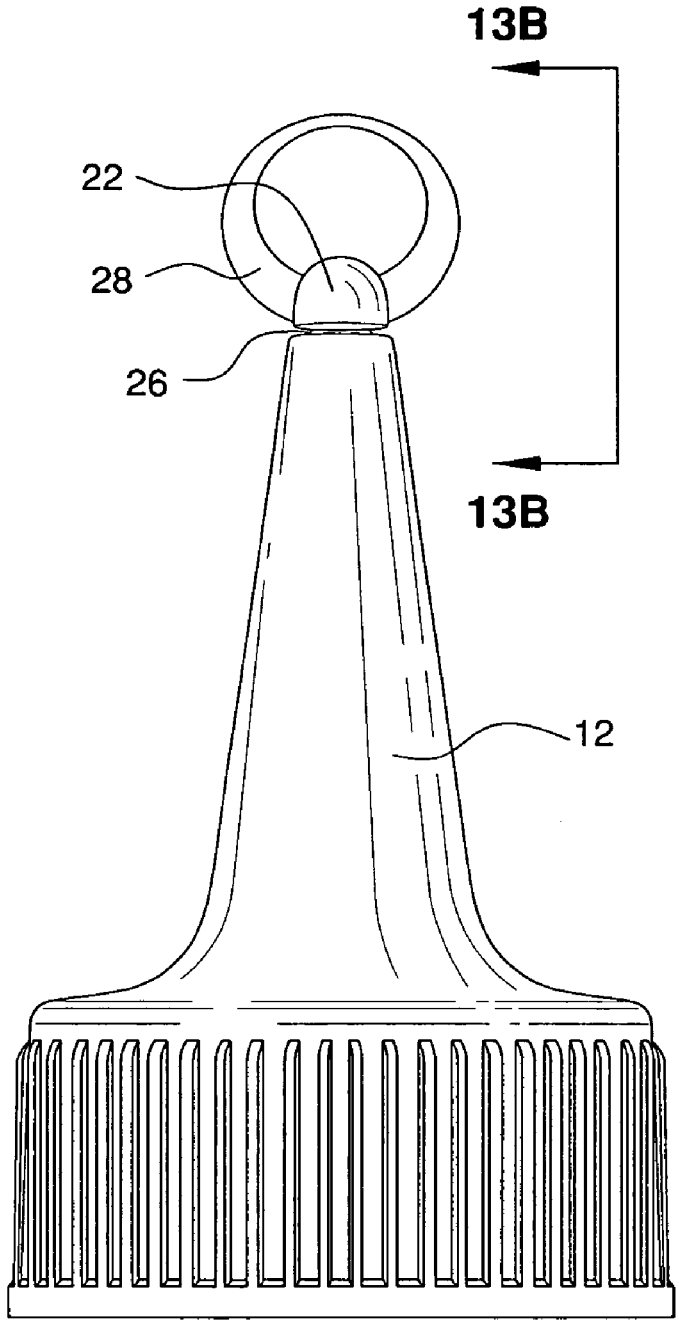
FIG. 13A is a front view of a dispensing nozzle according to the present invention.

As shown in FIGS. 13A and 13B, the flex area is created by a ring-like structure that is thinner at the top of the ring than it is at the bottom of the ring where in engages the tip end. The thickness of the ring gradually increases from the top of the ring to the bottom of the ring. Upon impact on the thinner area, loads are transferred from the thinner area to the area of the ring with the gradually increasing thickness. The load transfer causes the area of gradually increasing thickness to flex or bend at a flex area 204, thereby absorbing a substantial portion of the load. As a result, transfer of impact loads to the tip end 22 is limited.

Figure 14B:
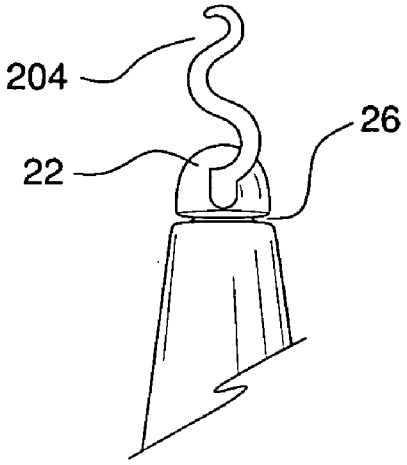
FIG. 14B is a partial side view of a tab on the dispensing nozzle shown in FIG. 14A.
Figure 14A:
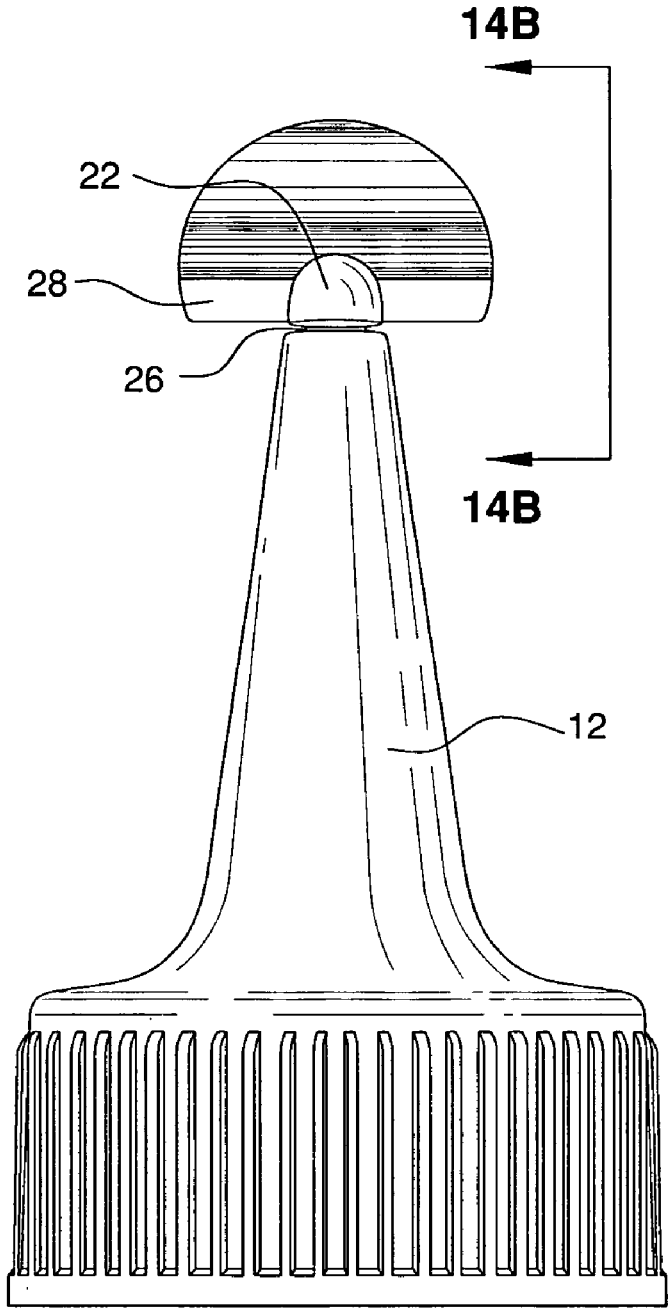
FIG. 14A is a front view of a dispensing nozzle according to the present invention.

As shown in FIGS. 14A and 14B, the flex area is created by an S-shaped orientation of tab 24. The S-shaped orientation allows the tab 24 to act as a spring that absorbs impact loads prior to the load reaching the tip end 22. Upon impact, the loads are transferred from the top of the tab to a flex area 204 that is apart from the tip end 22. The flex area 204 absorbs the load by flexing or bending, thereby limiting the impact load on the tip end 22.

In the event that the container with the top shown in the FIGS. 9 through 14 is dropped, the side impact loads will be absorbed by the flex area, causing the tab to flex. Under moderate impact loads, the tab will simply flex or bend about the flex area. Under heavier impact loads, the tab may break at the flex area. Whether or not the tab flexes or breaks under the load of impact, there is a greater transfer of energy away from the neck-down portion, which helps to prevent the container top from prematurely opening when dropped.

While each of the tops shown in FIGS. 9 through 14 have different configurations for the flex area, they all have a finger flange 28. The finger flange provides a substantially stiff (i.e., relatively inflexible) area for a user to twist the tab 24, allowing the user to disengage the tab from the nozzle portion 12 at the neck-down portion 26. With the tab removed, liquid, powder and/or gel can be dispensed through the nozzle portion 12.

Referring to FIGS. 15A through 15M, alternative embodiments of the tab 24 of the invention are shown. As shown, each of these embodiments include a finger flange 28. The finger flange 28 serves the same function as the finger flange described in the previous embodiments (i.e., providing a structure to allow a user to twist the tab).

Figure 15A:
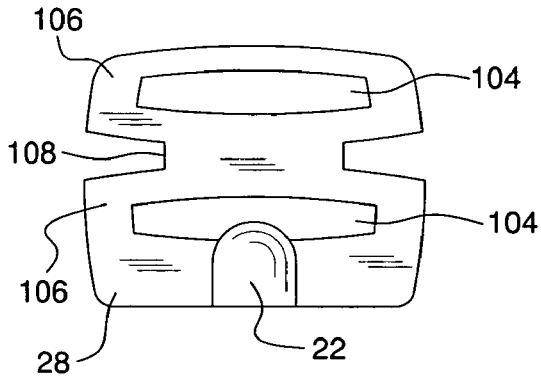
FIGS. 15A-15M are partial front views of alternate embodiments of the tab for a dispensing nozzle according to the present invention.

FIG. 15A shows the tab 24 in a shape that roughly resembles the number "8". The tab 24 has two substantially oval pieces 106 each having a slot 104 in the center. The two substantially oval pieces 106 are connected via a connector 108. The slots 104 in the substantially oval pieces 106 create the shock absorbing portion of the tab. Under impact, the load is absorbed around the perimeter of each of the slots 104. As a result, transfer of loads to the tip end 22 is limited.

Figure 15B:
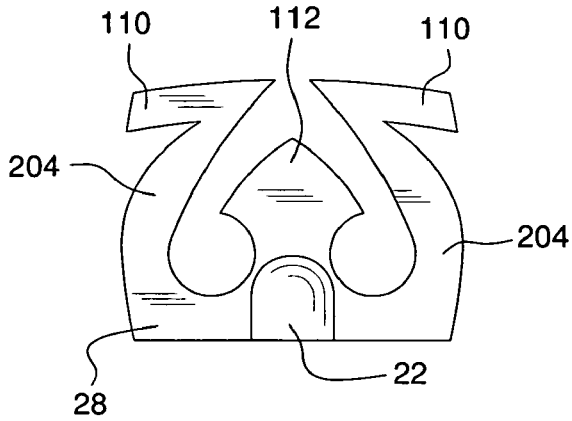

FIG. 15B shows the tab 24 in a shape that roughly resembles the letter "W". The tab 24 has two outer legs 110 and an inner leg 112 that together form the "W". As shown the inner leg 112 has an arrow head configuration and the outer legs have horizontal extensions extending from the top of the legs. This embodiment is not so limited. In this embodiment, the tab 24 can be any configuration that substantially forms a "W" shape. Under impact, the outer legs 110 flex about flex areas 204, thereby absorbing the impact load. As a result, transfer of loads to the tip end 22 is limited.

In addition to its functional benefits, the tab shown in FIG. 15B also has aesthetic benefits. For example, the tab can be used to sell a product whose name begins with "W" or to sell a product from a manufacturer whose name begins with "W".

Figure 15C:
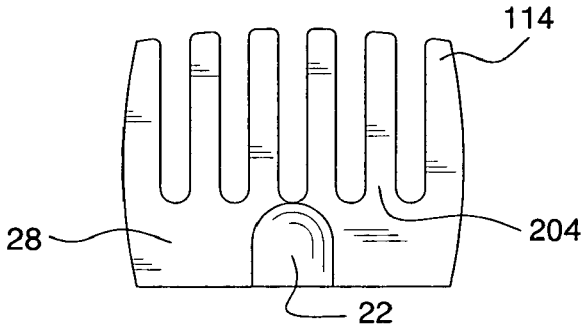

FIG. 15C shows the tab 24 in a shape that roughly resembles a comb. The tab has protrusions 114 that extend from the finger flange 28. Under impact, the protrusions 114 flex about flex areas 204, thereby absorbing the impact load. As a result, transfer of loads to the tip end 22 is limited.

Figure 15D:
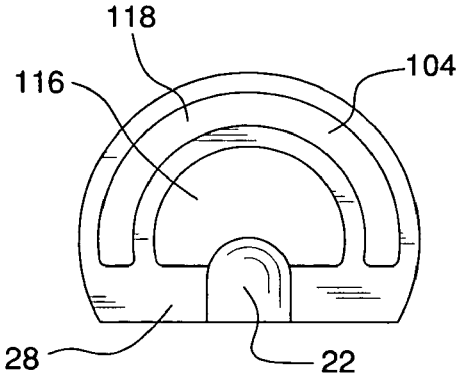

FIG. 15D shows the tab 24 having a first slot 116 and a second slot 118. The first slot 116 is a semi-circle. The second slot 118 parallels the perimeter of the first slot 116. The two slots are separated by a portion of the tab that is connected with the finger flange 28. Under impact, the load will be absorbed by the section of the tab located around the slots 116, 118.

Figure 15E:
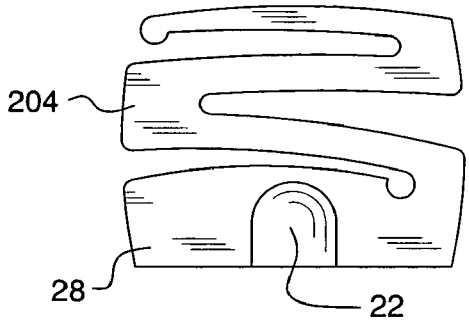

FIG. 15E shows the tab 24 that, in plan view, includes a series of alternating projections and recesses. The tab 24 absorbs impact loads in a spring-like manner. Upon impact, the loads are transferred from the top of the tab to a flex area 204. The flex area 204 absorbs the load by flexing or bending, thereby limiting the impact load on the tip end 22.

Figure 15F:
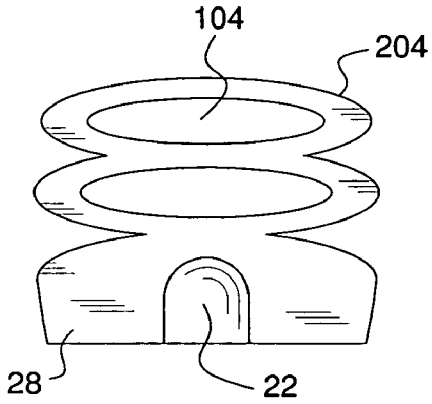

FIG. 15F shows the tab 24 in a configuration similar to the configuration shown in FIG. 15A. There are several differences between these two embodiments. First, the embodiment shown in FIG. 15F has rounded edges around the slots 104 as opposed to the more squared off edges shown in FIG. 15A. Second, the tip end 22 in FIG. 15F does not extend into a slot 104 as it does in FIG. 15A, resulting in a larger finger flange 28 with which a user can twist the tab 24.

Figure 15G:
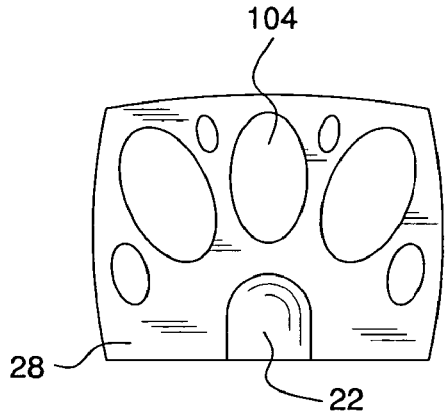

FIG. 15G shows the tab 24 having seven different slots 104 in three different sizes. The slots 104 create the shock absorbing portion of the tab. Under impact, the load is absorbed around the perimeter of each of the slots 104. As a result, transfer of loads to the tip end 22 is limited.

Figure 15H:
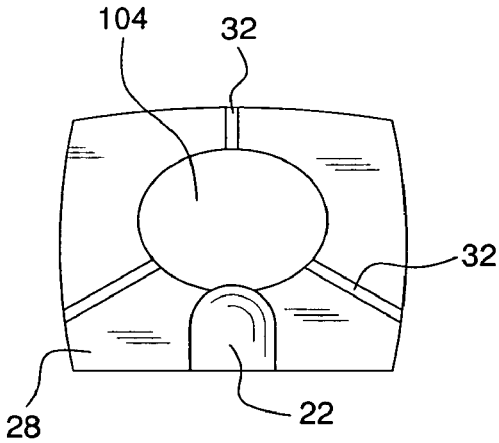

FIG. 15H shows the tab 24 having an oval slot 104 and three thinned portions 32, the three thinned portions are oriented such that they are approximately 60 degrees from one another. The combination of the slot 104 and the thinned portions 32 creates the shock absorbing portion of the tab. Under impact, the load is absorbed around the perimeter of the slot 104, with the majority of the load being absorbed by at least one of the thinned portions 32. Under moderate loads, the tab may bend at the thinned portions. Under higher loads, the thinned portions may break at the thinned portions. As a result, transfer of loads to the tip end 22 is limited.

Figure 15I:
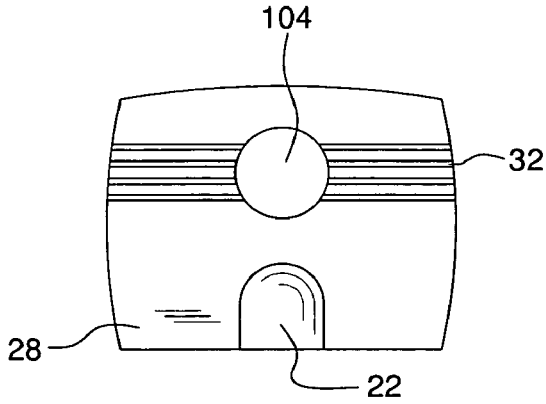

FIG. 15I shows the tab 24 having a substantially circular slot 104 and four horizontal thinned portions 32. The combination of the slot 104 and the thinned portions 32 forms the shock absorbing portion of the tab. Under impact, the load is absorbed around the perimeter of the slot 104, with the majority of the load being absorbed by at least one of the thinned portions 32. Under moderate loads, the tab may bend at the thinned portions. Under higher loads, the thinned portions may break at the thinned portions. As a result, transfer of loads to the tip end 22 is limited.

Figure 15J:
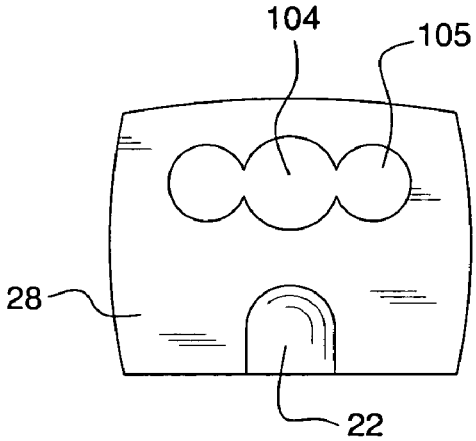

FIG. 15J shows the tab 24 having a single slot 104 connecting two smaller circular slots 105. The slots are configured such that a container having the tab to be hung on a display rack with a single rod or a double rod. The slots 104, 105 form the shock absorbing portion of the tab. Under impact, the load is absorbed around the perimeter of each of the slots 104, 105. As a result, transfer of loads to the tip end 22 is limited.

Figure 15K:
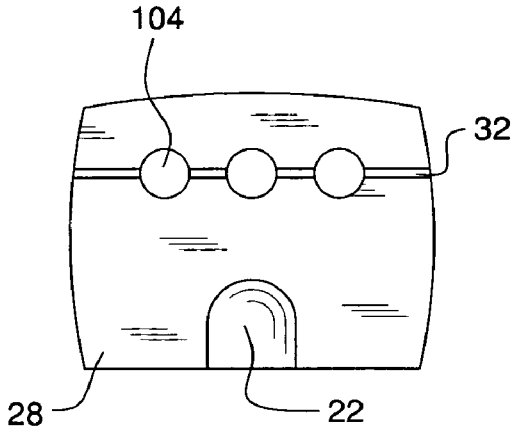

FIG. 15K shows the tab 24 having three substantially circular spaced apart slots 104 and four horizontal thinned portions 32. The combination of the slots 104 and the thinned portions 32 creates the shock absorbing portion of the tab. Under impact, the load is absorbed around the perimeter of the slots 104, with the majority of the load being absorbed by at least one of the thinned portions 32. Under moderate loads, the tab may bend at the thinned portions. Under higher loads, the thinned portions may break at the thinned portions. As a result, transfer of loads to the tip end 22 is limited.

Figure 15L:
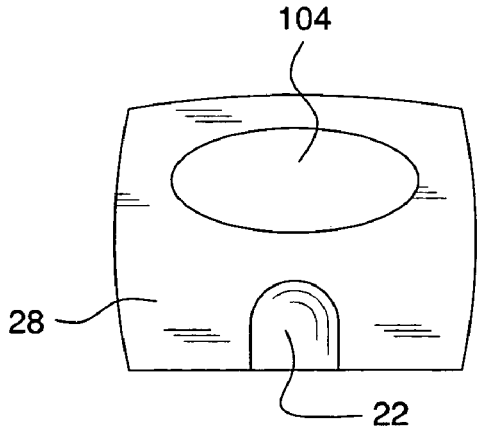

FIG. 15L shows the tab 24 having an oval slot 104. The slot 104 forms the shock absorbing portion of the tab. Under impact, the load is absorbed around the perimeter of the slot 104. As a result, transfer of loads to the tip end 22 is limited. As shown, the tab 24 also includes a finger flange 28.

Figure 15M:
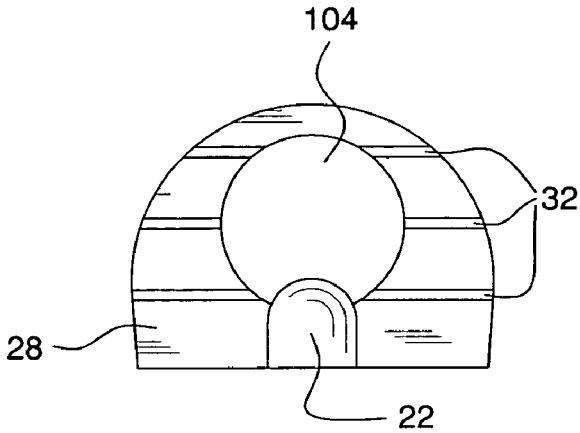

FIG. 15M shows the tab 24 having a substantially circular slot 104 and three horizontal thinned portions 32. The combination of the slot 104 and the thinned portions 32 forms the shock absorbing portion of the tab. Under impact, the load is absorbed around the perimeter of the slot 104, with the majority of the load being absorbed by at least one of the thinned portions 32. Under moderate loads, the tab may bend at the thinned portions. Under higher loads, the thinned portions may break at the thinned portions. As a result, transfer of loads to the tip end 22 is limited.

Preferably, the tabs 24 of the present invention have a width from about 0.25 inch to about 1 inch; more preferably, from about 0.4 inch to about 0.8 inch; and most preferably, from about 0.5 inch to about 0.625 inch. Preferably, the finger flange has a width that is greater than half of the width of the overall tab.

Preferably, the tabs 24 of the present invention have a height from about 0.15 inch to about 0.75 inch; more preferably, from about 0.25 inch to about 0.5 inch; and most preferably, from about 0.3 inch to about 0.4 inch. Preferably, the finger flange has a width that is greater than one quarter of the height of the overall tab.

The noted height and widths are the preferred dimensions. Dimensions larger and smaller dimensions than the preferred dimensions are contemplated to be within the scope of the present invention.

Preferably, the tabs 24 of the present invention are made from a molded plastic. Molded plastics are known by those skilled in the art. Therefore, for reasons of conciseness, they will not be enumerated herein. An example of a suitable material for the tabs 24 of the present invention is an impact resistant, soft thermoplastic elastomer.

Figure 8A:
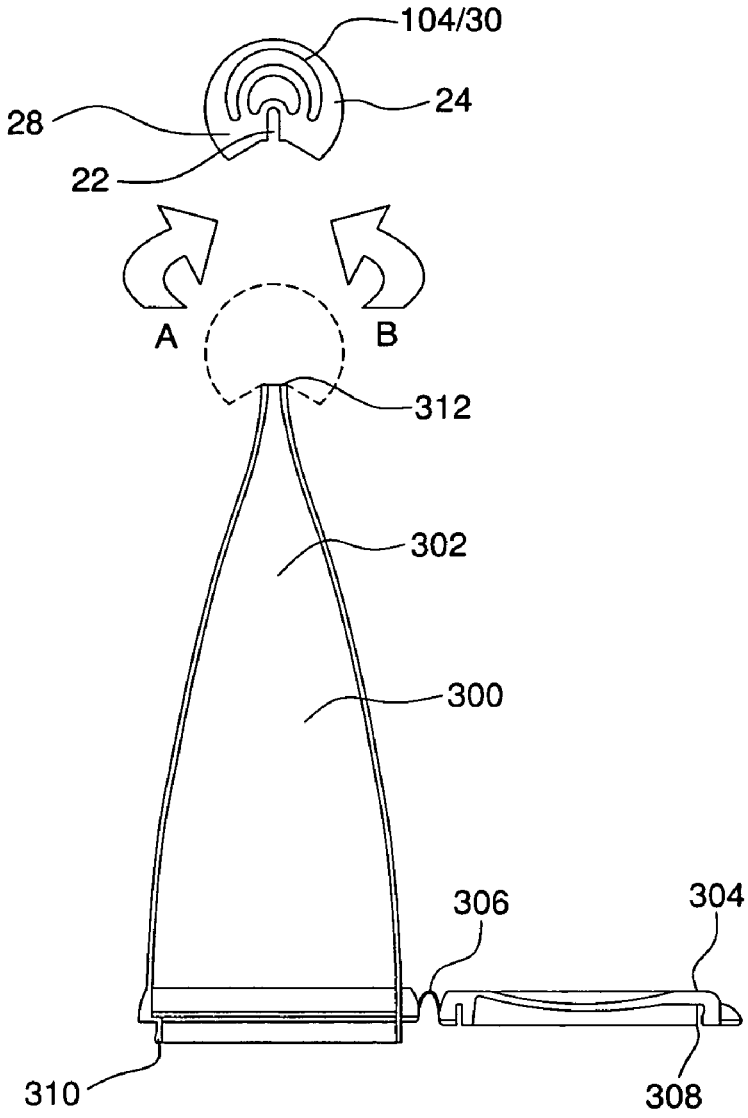
FIG. 8A is a cross-sectional view of a container according to the present invention with a detached tab section.
Figure 8B:
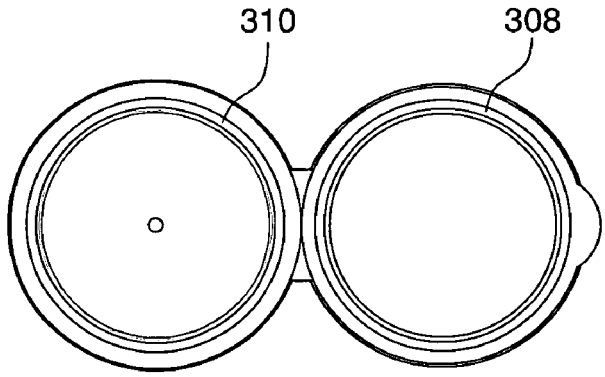
FIG. 8B is a bottom view of the container shown in FIG. 8A.

In addition to the various embodiments of the tab of the present invention discussed above, as shown in FIGS. 8A and 8B, other embodiments of the container body are also contemplated. FIGS. 8A and 8B show a disposable one piece container 300. The container 300 is injection molded, in its entirety, from one mold.

The container 300 includes a tab 24, a container body 302, and a cap 304. The tab 24 includes a finger flange 28, a tip end 22, and two shock absorbing portions 30. Each of the tab elements serves substantially the same purpose as described previously. As shown, the shock absorbing portions 30 include slots 104. Alternatively, the shock absorbing portions 30 can be thinned portions of the tab, flex areas in the tab, or combinations thereof.

The cap 304 is attached to the container body 302 by a molded hinge 306. The cap 304 can be opened to allow for filling of the container body 302. Once filled with a powder, liquid or other material, the cap 304 can be closed by engaging a female portion 308 of the cap 304 with a male portion 310 of the container body 300. An optional seal can be included at the engagement of the female portion with the male portion to provide for a more secure seal.

In operation, a user engages the finger flange 28 and twists the tab 24 in direction A and/or direction B. The twisting severs the tip end 22 from the container body 300 at a location 312, opening a conduit to allow the material stored in the container body to be removed.

It should be readily apparent that the cap can be molded from a single or multiple materials. For example, it is contemplated that the tab could be formed from a different material from the tip end, such as with a multi-material or co-injection molding process. The tab could be made from a material that is softer or more compressible than the tip end, thus providing the shock absorbing capability of the tab.

It will be appreciated by those skilled in the art, that the present invention may be practiced in various alternate forms and configurations. The previously detailed description of the disclosed embodiments is presented for purposes of clarity of understanding only, and no unnecessary limitations should be implied there from.

What is claimed is:

1. A dispensing nozzle top for a dispensing container, the top comprising:

a base having an axis;

a nozzle portion extending axially outward along a longitudinal axis from a first end of the base and disposed about the longitudinal axis, the nozzle portion having an outer wall defining an internal conduit for passage of a liquid, powder, or gel; and a tab integrally formed with the nozzle portion at a neck-down portion disposed about the longitudinal axis, the tab comprising:

a tip end sealing the internal conduit, the neck-down portion forming a removable connection of the tip end to the nozzle portion such that twisting of a portion of the tab will break the tip end from the nozzle portion thereby creating an opening into the internal conduit, the tip end not being reattachable to the nozzle portion after breaking at the neck-down portion, and at least one shock absorbing portion configured to bend independently from the neck-down portion and the remainder of the tab to dissipate at least some of an impact load applied to the tab along the longitudinal axis to inhibit fracturing of the neck-down portion;

wherein the at least one shock absorbing portion comprises a thinned flexible portion of the tab spaced axially apart from the neck-down portion and the nozzle portion, the thinned flexible portion having a thickness less than the thickness of the tab between the thinned portion and the neck-down portion, the thinned flexible portion of the tab lying in a plane that intersects the longitudinal axis.

2. A dispensing nozzle top according to claim 1 further comprising a depending skirt integrally formed with a second end of the base, wherein at least a portion of the outer wall or internal conduit tapers along the nozzle portion.

3. A dispensing nozzle top according to claim 2 wherein the depending skirt is engaged with a container body, the container body defining a reservoir for the liquid, powder, or gel.

4. A dispensing nozzle top according to claim 2 wherein a second end of the base is engaged with a container body, the container body defining a reservoir for the liquid, powder, or gel.

5. A dispensing nozzle top for a dispensing container, the top comprising:

a base having an axis;

a nozzle portion extending axially outward along a longitudinal axis from a first end of the base and disposed about the longitudinal axis, the nozzle portion having an outer wall defining an internal conduit for passage of a liquid, powder, or gel; and a tab integrally formed with the nozzle portion at a neck-down portion disposed about the longitudinal axis, the tab comprising:

a tip end sealing the internal conduit, the neck-down portion forming a removable connection of the tip end to the nozzle portion such that twisting of a portion of the tab will break the tip end from the nozzle portion thereby creating an opening into the internal conduit, the tip end not being reattachable to the nozzle portion after breaking at the neck-down portion, and at least one shock absorbing portion configured to bend independently from the neck-down portion and the remainder of the tab to dissipate at least some of an impact load applied to the tab along the longitudinal axis to inhibit fracturing of the neck-down portion;

wherein the at least one shock absorbing portion comprises a slot in the tab spaced axially apart from the neck-down portion and the nozzle portion, the slot intersecting the longitudinal axis.

6. A dispensing nozzle top according to claim 5 wherein the slot is crescent shaped.

7. A dispensing nozzle top according to claim 1 wherein the thinned portion of the tab has a thickness less than the thicknesses of the remainder of the tab and intersects the longitudinal axis of the base.

8. A dispensing nozzle top for a dispensing container, the top comprising:

a base having an axis;

a nozzle portion extending axially outward from a first end of the base and disposed about the axis, the nozzle portion having an outer wall defining an internal conduit for passage of a liquid, powder, or gel; and a tab integrally formed with the nozzle portion at a neck-down portion, the tab comprising:

a tip end sealing the internal conduit, the neck-down portion forming a removable connection of the tip end to the nozzle portion such that twisting of a portion of the tab will break the tip end from the nozzle portion thereby creating an opening into the internal conduit, the tip end not being reattachable to the nozzle portion after breaking at the neck-down portion, and at least one shock absorbing portion configured to bend to dissipate at least some of an impact load applied to the tab along the axis to inhibit fracturing of the neck-down portion;

wherein the at least one shock absorbing portion comprises a slot in communication with at least one portion of the tab having a thickness less than thicknesses of the remainder of the tab.

9. A dispensing nozzle top for a dispensing container, the top comprising:

a base;

a nozzle portion extending axially outward from the base, the nozzle portion defining a conduit for passage of a liquid, powder and/or gel; and a tab comprising a finger flange, a tip end sealing the conduit, and a first line of weakness, the tab being integrally formed with the nozzle portion at a second line of weakness, the first line of weakness being disposed outward from the second line of weakness, the first line of weakness separating the tab into a base portion located between the first line of weakness and the second line of weakness, and a shock absorbing portion located on the opposite side of the first line of weakness from the base portion;

wherein the second line of weakness creates a fracturable connection between the tip end and the nozzle portion such that twisting of the finger flange can break the tip end from the nozzle portion thereby creating an opening into the internal conduit, the tip end not being reattachable to the nozzle portion after breaking at the second line of weakness; and wherein the first line of weakness is configured to allow the shock absorbing portion to bend relative to the base portion of the tab in response to an impact load on the tab to inhibit fracturing of the second line of weakness.

10. A container for dispensing a liquid, powder or gel comprising:

a container body; and a dispensing nozzle top engaged with the container body and defining a conduit, the top comprising:

a base engaging the container body, the base having an axis; and a nozzle extending axially outward from the base and about the axis to a neck down portion, the conduit extending through the nozzle from the base, and a tab comprising a tip end integrally connected with the nozzle at the neck down portion, the tip end sealing off the conduit, a finger flange integrally connected with the tip end, and at least one shock absorbing portion spaced apart from the neck down portion in the outward direction, the neck down portion forming an removable connection between the nozzle tip and the tip end such that twisting of the finger flange can break the neck down portion, thereby creating an opening into the conduit, tip end not being reattachable to the nozzle after breaking at the neck-down portion, the shock absorbing portion being configured to bend independently from the neck down portion and the remainder of the tab to absorb at least some of an impact load on the tab directed along the axis to inhibit the neck down portion from breaking;

wherein the at least one shock absorbing portion comprises a thinned flexible portion of the tab spaced axially apart from the neck down portion and the nozzle, the thinned flexible portion having a thickness less than the thickness of the tab between the thinned portion and the neck down portion, the thinned flexible portion of the tab lying in a plane that intersects the axis of the base.

11. A container according to claim 10 wherein the container body and the top are separate molded pieces.

12. A container according to claim 11 wherein the top has a snap lock engagement with the container body.

13. A container according to claim 10 wherein the container body and the top are a single molded piece, and wherein the container body comprises a hinged end cap.

14. A dispensing nozzle top according for a dispensing container, the top comprising:

a base having an axis;

a nozzle portion extending from a first end of the base and disposed about the axis, the nozzle portion having an outer wall defining an internal conduit for passage of a liquid, powder, or gel; and a tab integrally formed with the nozzle portion at a neck-down portion, the tab comprising:

a tip end sealing the internal conduit, the neck-down portion forming a removable connection of the tip end to the nozzle portion such that twisting of a portion of the tab will break the tip end from the nozzle portion thereby creating an opening into the internal conduit, and at least one shock absorbing portion configured to bend to dissipate at least some of an impact load applied to the tab along the axis to inhibit fracturing of the neck-down portion;

wherein the at least one shock absorbing portion comprises a slot in communication with at least one portion of the tab having a thickness less than thicknesses of the remainder of the tab;

wherein the slot extends laterally across a central portion of the tab and wherein there are two portions of the tab that have a thickness less than thicknesses of the remainder of the tab, each portion being defined by a recess into the tab and extending laterally from an end of the slot to a lateral edge of the tab.

15. A dispensing nozzle top according to claim 14 wherein the tab includes two depending portions that extend downward from the shock absorbing portion and below the necked down portion to form a finger flange.

16. A dispensing nozzle top for a dispensing container, the top comprising:

a nozzle portion defining a conduit, the nozzle portion extending axially outward from a base, the conduit extending through the nozzle portion from the base to a tip end;

a tab integrally formed with the nozzle portion near the tip end at a neck-down portion for sealing the conduit, the neck-down portion being fracturable by a force applied to the tab to create an opening into the conduit at the tip end of the nozzle portion, the tab including a shock absorbing portion disposed farther from the base than the neck-down portion, the shock absorbing portion being configured to bend independently from the neck-down portion and the remainder of the tab to inhibit the transfer to the neck-down portion of at least some loads applied to the tab, wherein the shock absorbing portion comprises a thinned flexible portion of the tab spaced axially apart from the neck-down portion and the nozzle portion, the thinned flexible portion having a thickness less than the thickness of the tab between the thinned portion and the neck-down portion, the thinned flexible portion of the tab lying in a plane that intersects a longitudinal axis of the nozzle portion; and wherein the tab is not reattachable to the nozzle portion after breaking at the neck-down portion.

17. A dispensing nozzle top for a dispensing container, the top comprising:

a nozzle portion extending axially outward from a base to a tip end and having a conduit extending through the nozzle portion from the base to the tip end;

a tab end for sealing the conduit near the tip end, the tab end being integrally formed with the nozzle portion at a neck-down portion, the tab end comprising:

a finger flange for applying force to break the tab end away from the nozzle portion at the neck-down portion to create an opening in the tip end; and a shock absorbing portion for reducing the transfer to the finger flange of at least some of an impact load applied to the tab end in an axial direction, thereby inhibiting the tab end from breaking away at the neck-down portion;

wherein the finger flange is disposed between the neck-down portion and the shock absorbing portion;

wherein the shock absorbing portion comprises a thinned flexible portion of the tab end spaced axially apart from the neck-down portion and the nozzle portion, the thinned flexible portion having a thickness less than the thickness of the finger flange between the thinned portion and the neck-down portion, the thinned flexible portion of the tab end lying in a plane that intersects a longitudinal axis of the nozzle portion; and wherein the tab end is not reattachable to the nozzle portion after breaking at the neck-down portion.

18. A dispensing nozzle top for a dispensing container, the top comprising:

a nozzle portion defining a conduit, the conduit extending through the nozzle portion from a base to a tip end; and a tab integrally formed with the nozzle portion, the tab comprising a finger flange, a tip end sealing the conduit, a first area of weakness located in the finger flange, and a second area of weakness located between the tab and the nozzle portion;

wherein the first area of weakness is adapted to permit a portion of the finger flange to bend relative to the remainder of the finger flange to redirect impact loads along an axis of the nozzle portion away from the second area of weakness, the first area of weakness comprising a thinned flexible portion of the tab spaced axially apart from the second area of weakness and the nozzle portion, the thinned flexible portion having a thickness less than the thickness of the tab between the thinned portion and the second area of weakness, the thinned flexible portion of the tab lying in a plane that intersects a longitudinal axis of the nozzle portion;

wherein the second area of weakness creates a breakable connection between the tip end and the nozzle portion such that twisting of the finger flange can break the tip end from the nozzle portion thereby creating an opening into the conduit, the tab not being reattachable to the nozzle portion after breaking at the second area of weakness.

* * * * *